US006729519B2

(12) United States Patent
Kestler

(10) Patent No.: US 6,729,519 B2
(45) Date of Patent: May 4, 2004

(54) LAUNDRY BACKPACK BAG

(76) Inventor: Jeremy B. Kestler, 1349 Sheffield Glen Way NE., Atlanta, GA (US) 30329

( * ) Notice: Subject to any disclaimer, the term of this patent is extended or adjusted under 35 U.S.C. 154(b) by 63 days.

(21) Appl. No.: 10/135,305

(22) Filed: Apr. 30, 2002

(65) Prior Publication Data

US 2003/0201291 A1 Oct. 30, 2003

(51) Int. Cl.[7] ..... A45F 4/00; A45C 15/00

(52) U.S. Cl. ..... 224/584; 224/231; 224/237; 383/13; 383/23

(58) Field of Search ..... 224/584, 630, 224/643, 652, 653, 655, 575, 231, 627, 237; 383/13, 22, 23

(56) References Cited

U.S. PATENT DOCUMENTS 4,773,585 A * 9/1988 Lehrman ..... 232/1 B
4,784,248 A * 11/1988 Workman ..... 190/126
5,016,792 A * 5/1991 Jay ..... 224/155
5,050,998 A * 9/1991 Wachtel ..... 383/6
5,458,278 A * 10/1995 LaConte ..... 224/651
5,503,476 A * 4/1996 Hamdan ..... 383/9
5,927,581 A * 7/1999 Reddy et al. ..... 224/578
6,092,702 A * 7/2000 Cassidy, IV ..... 224/153
6,237,825 B1 * 5/2001 Pencoske ..... 224/645
6,286,461 B1 * 9/2001 Martz ..... 119/497
6,353,941 B1 * 3/2002 Manning et al. ..... 4/239
6,386,414 B1 * 5/2002 Kilduff ..... 224/638
6,592,012 B2 * 7/2003 Godshaw et al. ..... 224/153

FOREIGN PATENT DOCUMENTS

FR 2634514 A3 * 1/1990
JP 1133195 * 12/1999
WO WO9631402 * 10/1996

* cited by examiner

*Primary Examiner*—Sue A. Weaver
(74) *Attorney, Agent, or Firm*—Thomas, Kayden Horstemeyer, & Risley, L.L.P.

(57) ABSTRACT

A laundry backpack, which can be hung from a door, which has a D-shaped perimeter frame in the front and back of the backpack. The laundry backpack has closeable flaps in the front, top and bottom. The laundry backpack may have a firm material in the top or bottom for front to back for support. The laundry backpack has a detachable hanging strap with a U-shaped hanger for hanging over a door.

16 Claims, 5 Drawing Sheets

LAUNDRY BACKPACK BAG

FIELD OF THE INVENTION

The present invention relates generally to a laundry backpack, primarily for use in carrying laundry from a residence, such as in a college dormitory or an apartment complex or to a laundromat and back. This laundry backpack has straps with U-shaped hangers for hanging on the door of a room such as a bedroom and for carrying on the back of a person. Two D-shaped perimeter wires retain the backpack's shape. It has flaps for the loading of soiled laundry and unloading at the laundromat and loading with folded laundry to carry home.

BACKGROUND OF THE INVENTION

Persons who do not have a washing machine in their own home, apartment or room, typically utilize a laundry bag to transport their laundry to centrally located washing machines. Students who live in dormitories or apartment complexes may be able to wash their clothes at washing machines, which may be centrally located in their dormitory or apartment complex or may have to go to a commercial laundromat. The most familiar laundry bag is a simple cloth bag with a drawstring closure. This bag has remained unchanged over a long period and as a result, there are a number of difficulties and inconveniences in using this bag. For example, the bag when it is loaded with laundry is a relatively heavy and bulky load, which cannot be easily carried or hung without a hook or by placing a nail in the wall. Students in particular have complained about the simple laundry bag because it takes up too much space in their room or bathroom and is disorganized and too heavy to carry, resulting in the necessity to make several trips to the laundry facility. Both the conventional laundry bag and baskets for carrying laundry are difficult and cumbersome to carry, especially for smaller people. Frequently, the laundry overflows the basket and falls onto the ground or dirty hallway floors.

PRIOR ART

U.S. Pat. No. 5,050,998 issued Sep. 24, 1991, of which Wachtel is the inventor, discloses a laundry bag, which is divided into two (2) compartments with a drawstring closure at the top. The bottom of each compartment has a zipper closure, which allows discharging each compartment individually. The dual laundry bag has a pair of carrying straps with an adjustable belt for attachment of clothing. This laundry bag can be carried on the user's back utilizing the two (2) carrying straps. It is also provided with pockets to carry various items such as detergent and reading materials. It is specifically designed to carry laundry from a person's residence to a laundromat.

U.S. Pat. No. Des. 363,370 issued Oct. 17, 1995 to Hamdan, shows a design for a laundry bag, which has two (2) compartments and can be carried on the back. This laundry bag is disclosed in more detail in U.S. Pat. No. 5,503,476 issued Apr. 2, 1996 to Hamdan.

U.S. Pat. No. 5,458,278 issued Oct. 17, 1995 to LaConte discloses a laundry bag, which has a conventional drawstring at the top to open and close the opening. A zipper extends along the length of the laundry bag. This bag is designed to be carried over a person's shoulders.

U.S. Pat. No. 4,094,351 issued Jun. 13, 1978 to Catenaccio discloses a laundry bag with a shoulder strap with rope loops to close the top of the bag. It has a utility bag attached to the end of the shoulder strap for carrying detergent and reading materials.

A backpack laundry bag marketed under the name Laundra-Mate® is described in literature distributed by New Vision Enterprises®. It is a large cumbersome backpack that has the appearance of a conventional backpack with several compartments on the back.

OBJECTS OF THE INVENTION

It is an object of the present invention to provide a laundry bag that can be carried on the back and will support approximately two (2) washer loads of laundry.

It is a further object of this invention to provide a laundry backpack that can be hung over a door in a room for convenience in loading and storing soiled laundry.

It is a further object of this invention that the bag will stand upright when empty.

Another object of the present invention is to provide a laundry backpack that can carry folded laundry from the laundry facility back to the room without wrinkling the clothing.

A further object of the present invention is to provide a laundry backpack, which incorporates fast zipper closures.

Another object of the present invention is to provide a laundry backpack, which has pockets for the storage of various items such as laundry soaps and detergents, personal radios, magazines, books, notebooks and the like.

The final object of the present invention is to provide a laundry backpack, which comprises a relative small number of simple component parts, which can be manufactured in an economical manner.

SUMMARY OF THE INVENTION

These and other objects, features, and advantages of the present invention will become more apparent upon reading the following specification in conjunction with the accompanying drawings and figures.

These objects are achieved by having a laundry backpack bag which has D-shaped perimeter wires in the front and back of the laundry backpack and the closeable flap in the top and a closeable flap in the front for inserting and discharging laundry. The D-shaped metal or plastic wire perimeter frames between the front wall and the top, bottom and sidewalls and between the back wall, bottom and sidewalls preserves the vertical shape of the bag. There is a rigid horizontal support which may be in the form of the D-ring, firm material or staves in the top or the bottom of the pack. These perimeter frames and horizontal supports provide some rigidity to the structure. The laundry backpack also has a closeable flap in the bottom for discharging laundry.

The laundry backpack can have a mesh material in a substantial part of the sidewalls for ventilation purposes.

This laundry backpack has carrying straps so it can be carried on the back of a person and which can be attached to the U-shaped hangers at one end for hanging on a door for loading the backpack with laundry or for unloading the laundry.

The laundry backpack can be easily opened by providing double zippers on all of the closeable flaps.

DETAILED DESCRIPTION OF A PREFERRED EMBODIMENT

Figure 3:
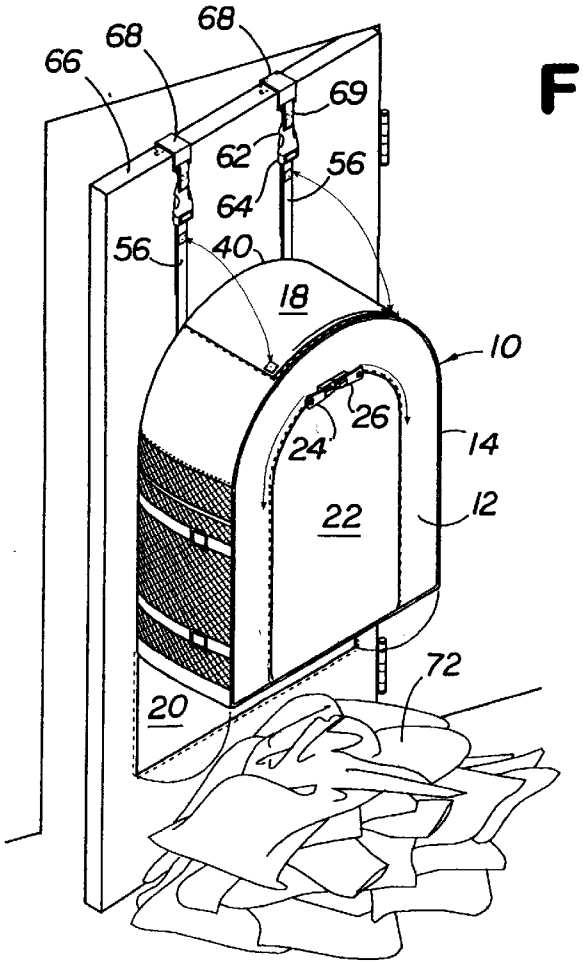
FIG. 3 is a perspective view of one embodiment of the laundry backpack bag hung on a door with the bottom flap open for depositing dirty laundry.
Figure 7:
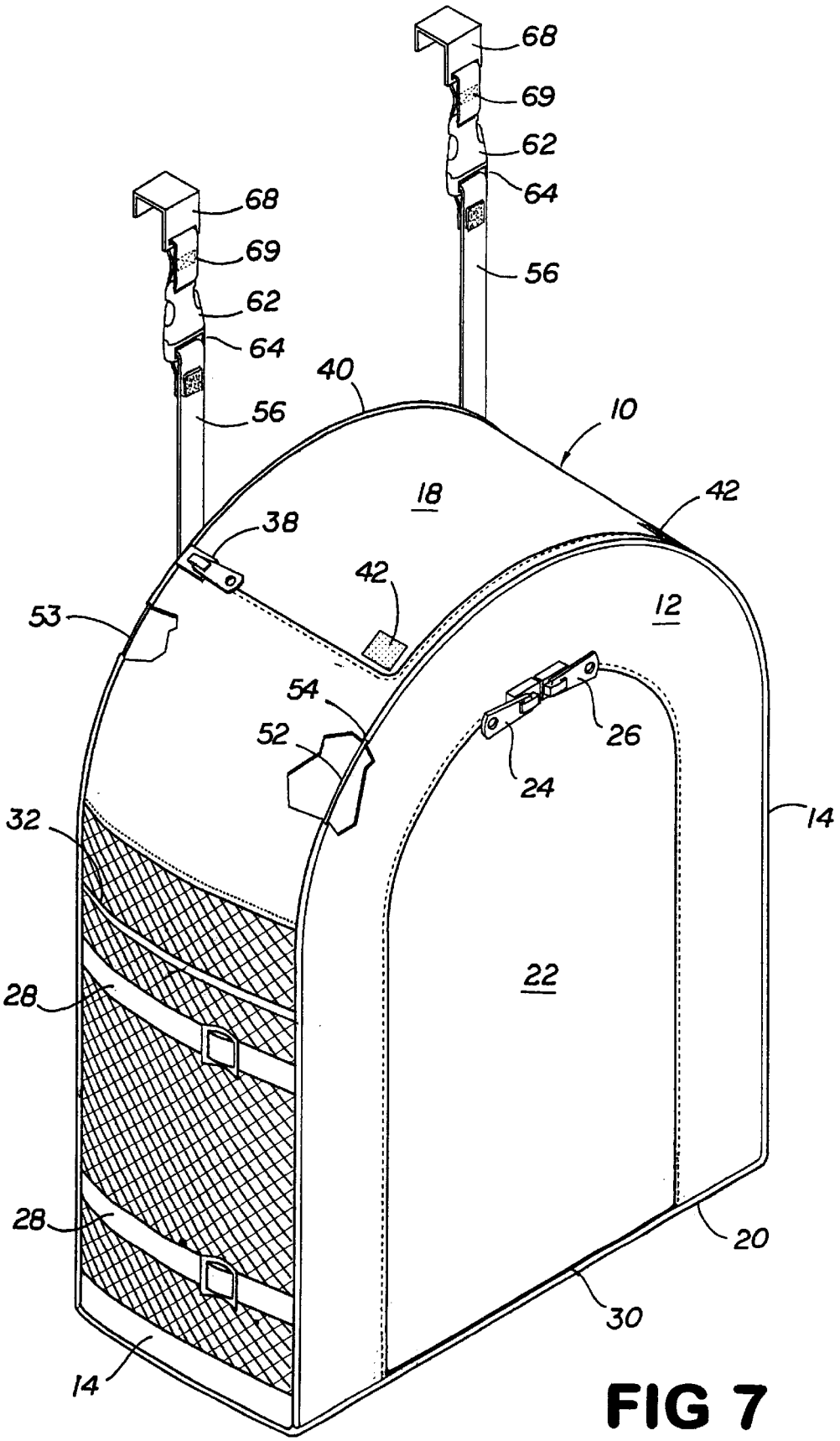
FIG. 7 is a perspective detailed view of the front of the laundry backpack bag.

The laundry backpack of this invention is illustrated in detail in FIG. 7. The numeral 10 delineates the laundry backpack, which has a front wall 12 attached to two sidewalls 14 which in turn are attached to backwall 16. The laundry backpack 10 has a top flap 18 and a bottom flap 20 and a front flap 22 for easy access to the backpack 10, as shown in FIG. 3. The laundry backpack can be constructed of any suitable fabric, such as cotton, canvas or nylon. It may be washable to sustain long term use.

The front flap 22 can be opened and closed by any suitable fastening means, but dual zippers 24 and 26 are preferred for the ease and speed of opening and closing, as shown in FIG. 7.

The sidewalls 14 may have adjustable straps 28 which can be tightened or loosened to accommodate the load being carried by the laundry backpack 10. The sidewalls 14 may be constructed of a ventilation mesh to prevent damp or wet laundry from mildewing and smelling.

This laundry backpack bag 10 can be provided with numerous pockets such as side pocket 32 which can be included on both sides 14 of the laundry backpack 10. These pockets may be used for holding miscellaneous items such as beverages, snacks, reading materials, shoes, detergents, tapes and compact discs. These pockets can be opened and closed by any suitable means such as a hook and loop material such as Velcro® or they may be left open if closure is not essential.

The top flap 18 may have a stave pocket 34 for containing a rigid stave 36 to assist in maintaining structural rigidity of the laundry backpack 10. This stave can constructed of any suitable material such as plastic, wood, closed cell foam or even paperboard or metal. It can be easily removed for washing the backpack. The top flap 18 can be secured by any suitable means such as zipper 38.

Alternatively, a D-ring of plastic or metal (not shown) can be provided in top wall 19 to provide horizontal support. Horizontal supports needs to be provided in either the top or bottom wall to maintain the shape of the laundry backpack bag. Dual zippers 38 may be used on each side of top flap 18 for ease in opening. The top flap can be constructed of Velcro® material that is self-rolling.

An alternative way of keeping the top flap vertical is to have hook and loop fasteners 42 on the flap 18 with a corresponding hook and loop fastener on the strap or on a door or other structure on which the laundry backpack 10 may be hung, as shown in FIG. 3.

Figure 9:
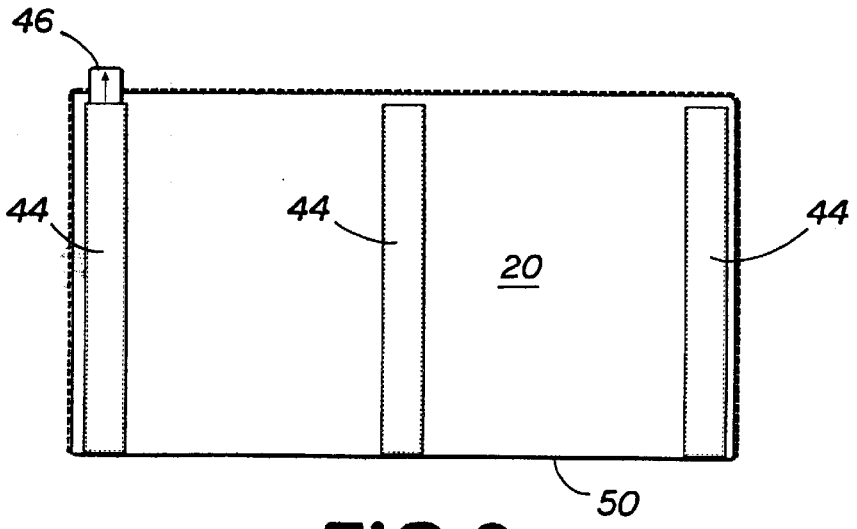
FIG. 9 is a cross sectional bottom of the laundry backpack bag.

The bottom flap 20 may also have stave pockets 44 in which staves 46 are located. A plurality of staves 46 is illustrated in FIG. 9, but it should be realized that a single large stave might also be used. A plurality of smaller staves is used in order to decrease the weight of this laundry backpack 10. These staves can also be constructed of the same type of material that the stave 36 for the top flap is constructed and can be easily removed for washing. Horizontal support can be provided by closed cell foam in the bottom flap 20, which may in fact constitute the bottom flap.

Figure 8:
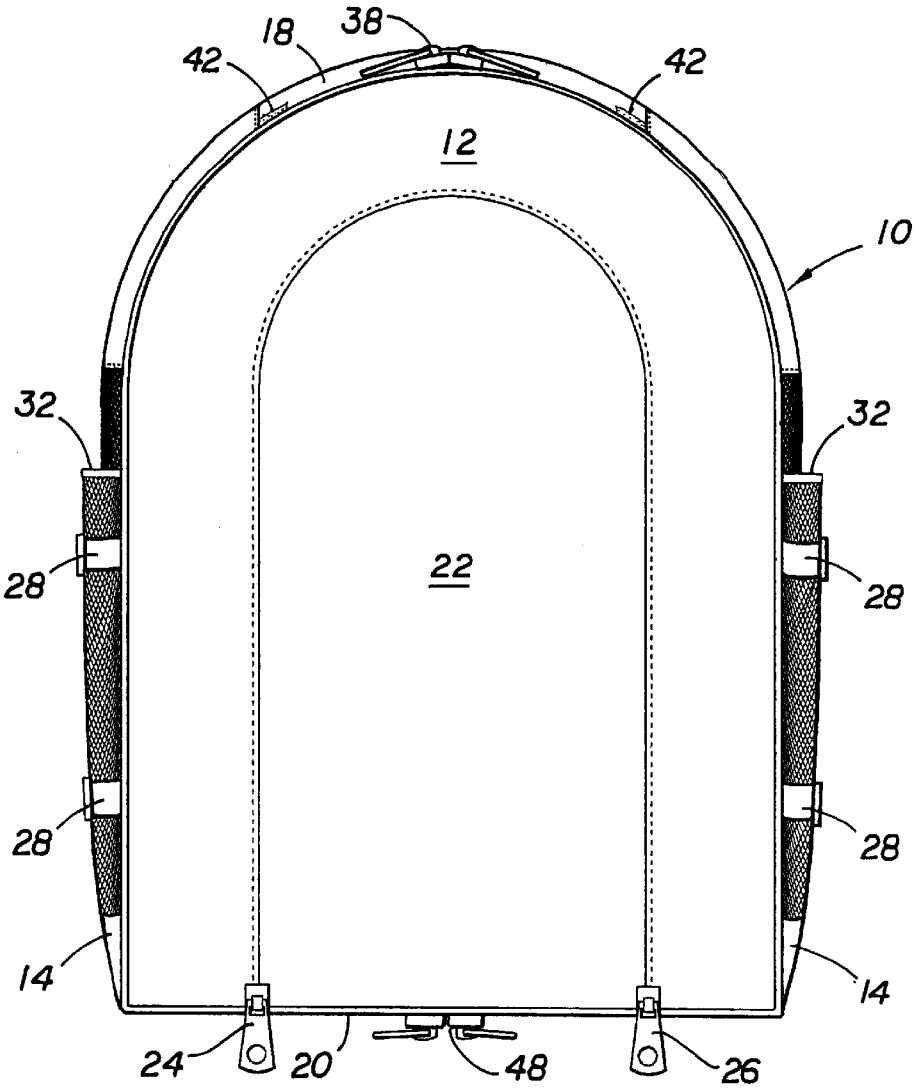
FIG. 8 is a view of the front of the laundry bag.

The bottom flap 20 may also have dual zippers 48 for securing the bottom flap to the laundry backpack 10, as shown in FIG. 8. Again, dual zippers 48 may be used for ease and speed in opening and closing the laundry backpack 10. A hinge 50 may be needed at the back of bottom flap 20 to facilitate the flap opening and closing. This hinge 50 and the hinge 40 at the top of the backpack can be constructed of any suitable material, such as a metal or plastic hinge, or could simply be a hinge formed in a material of which the laundry backpack 10 is constructed.

A D-shaped perimeter wire 52 may be inserted in the front of the laundry backpack 10 through tunnels 54 shown in the cut away in FIG. 7 to provide vertical support to the laundry backpack. These tunnels 54 may be constructed as simple loops, or Velcro® straps, which can be snapped around the perimeter wire 52 to hold it in place and which can be unsnapped to remove the perimeter wire for washing the laundry backpack 10. The D-shaped perimeter wire may be constructed of any suitable material such as wire or plastic. Similarly, a D-shaped perimeter wire 53 may be inserted in the back of the laundry backpack 10 through tunnels (not shown). The D-shaped perimeter wire may be an inch or so shorter in the back than in the front to make the backpack less bulky and more attractive.

Figure 2:
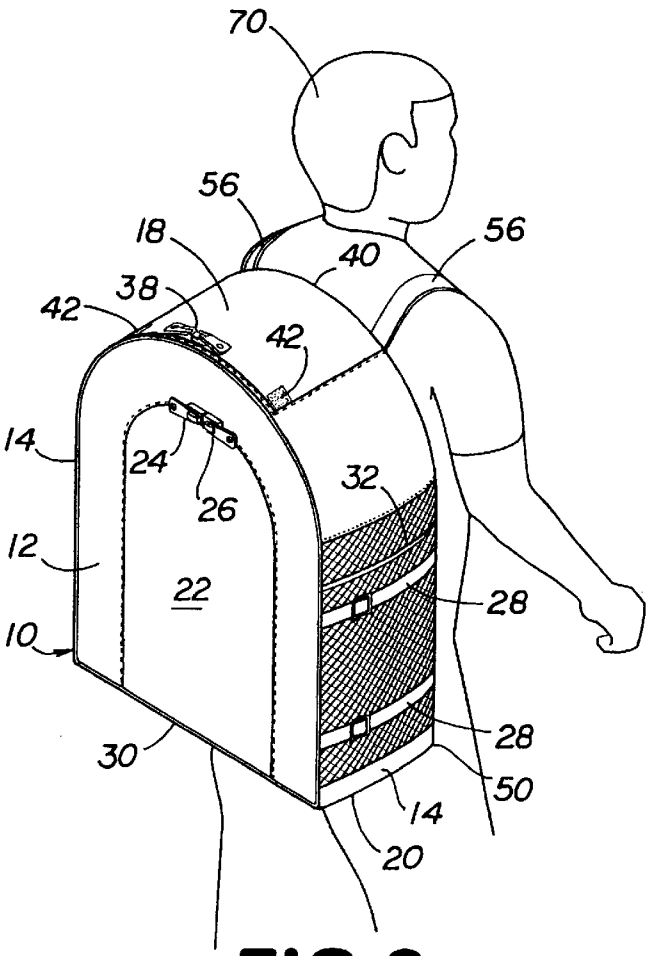
FIG. 2 is a perspective view of one embodiment of the laundry backpack bag of this invention being carried by a person.
Figure 1:
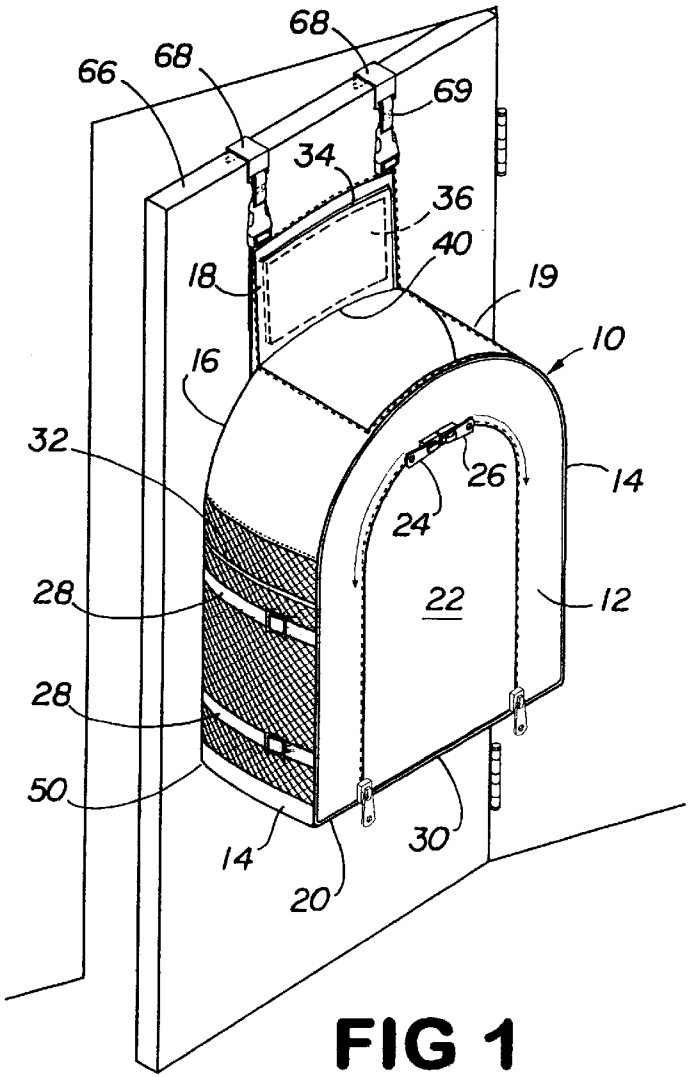
FIG. 1 is a perspective view of one embodiment of the laundry backpack bag of this invention, which is hung on a door by straps.
Figure 6:
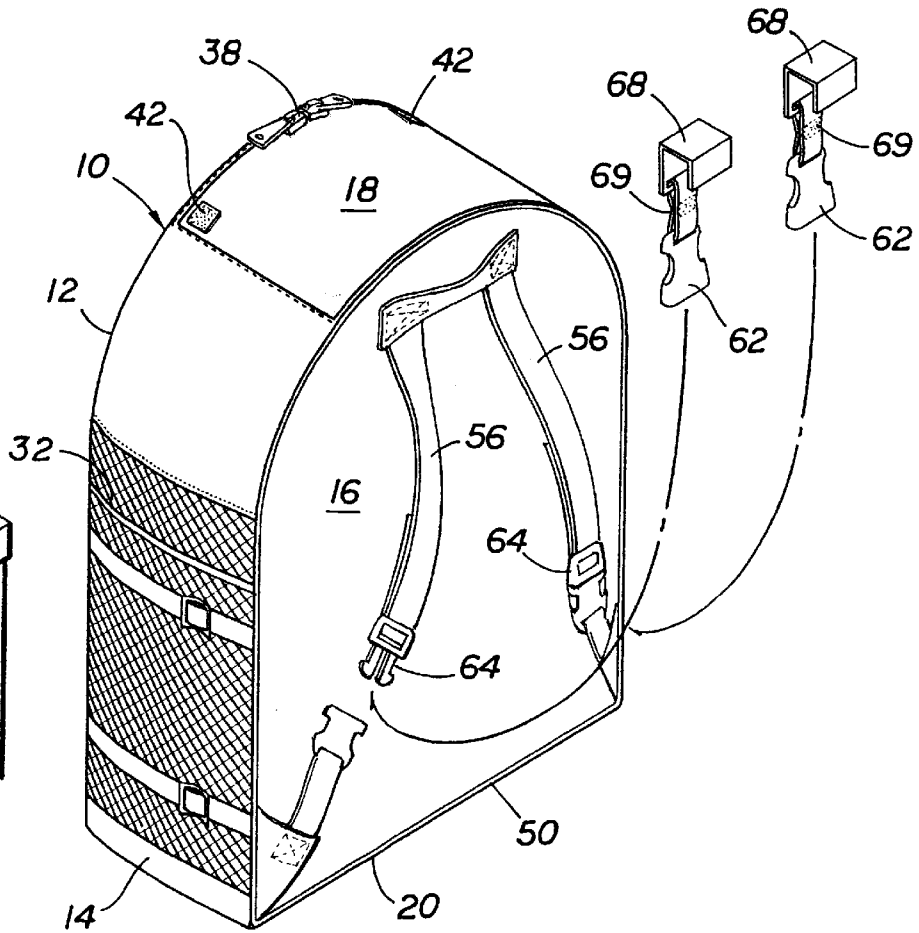
FIG. 6 is a perspective view of the laundry backpack bag illustrating how the U-shaped hangers attach to the carrying straps.

As is self-evident from the name, this laundry backpack 10 is designed to be carried on a person's back as illustrated in FIG. 2. This is facilitated by the use of conventional carrying straps 56 as illustrated in FIGS. 2 and 6. The laundry backpack 10 can be hung on the back of a door 66 by carrying straps 56 attached to U-shaped hangers 68 by a short strap 69 as illustrated in FIG. 1 and FIG. 6. These U-shaped hangers can be constructed large enough in width to fit over all normal doors. These U-shaped hangers can be constructed of metal or a rigid plastic. The U-shaped hangers 68 with a short strap 69 may be connected to the carrying straps 56 by a female/male snap lock arrangement. Preferable, a female lock 62 is attached to short strap 69 and a male snap lock 64 is attached to the carrying strap 56. It should be understood that the locks on the carrying strap 56 can be male or female as long as the locks on the short strap 69 are the opposite. The use of a male snap lock 62 and a female snap lock 64 on the back of the backpack facilitates the use of the straps connecting the two for carrying in a different manner than over the shoulders.

A door in a bathroom or a student's room is a convenient place in which to hang the laundry backpack for filling with laundry. The top flap 18 can be left open and held against the back of a door by hook and loop fastener 42 or any other convenient means, as shown in FIG. 1. A corresponding hook and loop fastener could be placed on the straps. Soiled laundry can be deposited in the top of the laundry backpack 10 through the opening formed by top flap 18. Alternatively, laundry can be placed in the laundry bag through front flap 22 which can be opened. It is easier to finish filling the laundry backpack 10 through the top flap 18.

Figure 4:
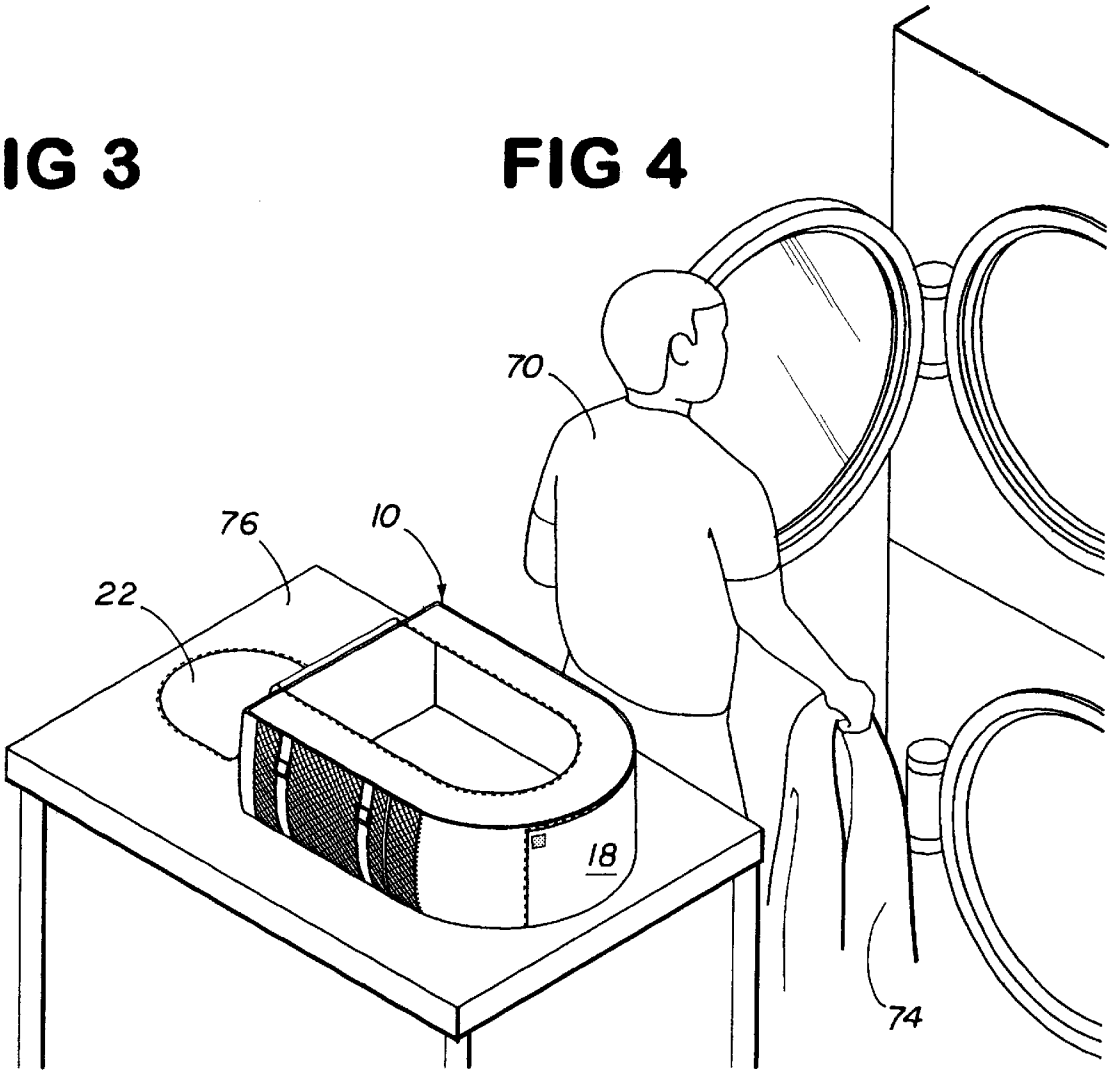
FIG. 4 is a perspective view of laundry being taken out of the dryer.
Figure 5:
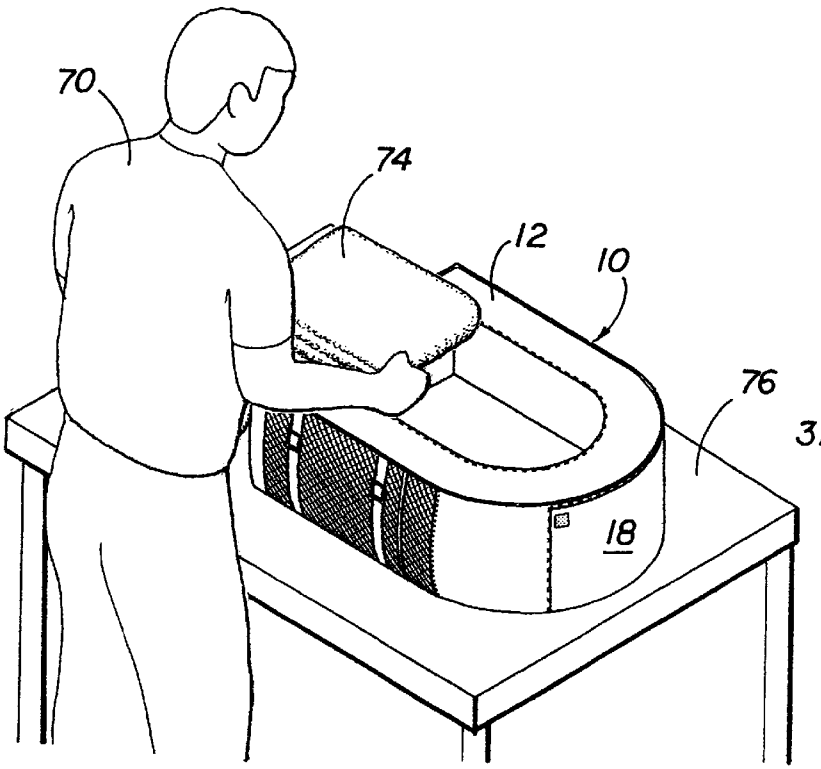
FIG. 5 is a perspective view of the laundry backpack bag that is placed on a table and in the process of being loaded with fresh laundry.

When the laundry backpack 10 is filled it can be removed from the back of the door and carried by carrying straps 56 by a person 70 as illustrated in FIG. 2 to the central laundry facility of commercial laundromat or the laundry room in someone's home. Carrying straps 56 can be hung on a door in the laundromat as illustrated in FIG. 3 and the dirty laundry 72 dumped through the bottom flap 20. Alternatively, the laundry can be removed through the top flap 18 or the front flap 22. After the laundry has been completed, the clean laundry 74 can be removed from the dryer as shown in FIG. 4 and placed in the laundry backpack 10 located on a table 76 as shown in FIG. 5 and carried back to the person's residence.

While the invention has been disclosed in its preferred forms, it will be apparent to those skilled in the art that many modifications, additions, and deletions can be made therein without departing from the spirit and scope of the invention and its equivalents as set forth in the following claims.

UNIQUE FEATURES OF THIS INVENTION

The laundry backpack of this invention has several features that make it unique and very useful in the transporting of laundry from a residence to a central laundry facility or commercial laundromat or within a home. The two dimensional rigidity of the backpack is preserved by the D-shaped perimeter wires. The front to back rigidity of the laundry backpack is maintained by staves or firm materials in the bottom or top. These are important features to maintain the shape of the laundry backpack as illustrated in FIG. 7 and to preserve that shape whether empty or full. This shape is preserved by the utilization of lightweight form preserving materials such as the D-shaped perimeter wires. The use of multiple staves or firm material in the bottom or top preserves the shape while being very lightweight which is essential for a laundry backpack.

The convenience of this laundry backpack is greatly enhanced by the use of the U-shaped hangers for hanging the laundry backpack on a door in a residence or a door of a room. This laundry backpack is especially useful for students who have to take their laundry to a central laundry facility or a commercial laundromat. Hanging the laundry backpack on a door greatly eases the burden of loading the laundry backpack with laundry through the top flap or front flap. The staves or firm materials and D-shaped perimeter wires preserve the shape of the laundry backpack during the loading so it does not collapse in a form like a conventional laundry bag with drawstrings.

The ability to use the carrying straps to hang the backpack on a door with the U-shaped hangers and the utilization of the preferred female/male lock arrangement contribute to the convenience of this backpack.

What is claimed:

1. A laundry backpack bag for carrying and for hanging from an object, said backpack comprising:

a. a front wall with edges;

b. a back wall;

c. two intervening side walls with edges with one edge attached to the front wall and another edge attached to the back wall;

d. an intervening curved top wall with edges with one edge attached to the front wall and another edge attached to the back wall;

e. an intervening bottom wall with edges with one edge attached to the front wall and another edge attached to the back wall;

f. a wire-like D-shaped frame attached to the laundry backpack along the edges between the front wall, side wall, top wall and bottom wall;

g. a wire-like D-shaped frame attached to the laundry backpack along the edges between the back wall, side wall, top wall and bottom wall;

h. the laundry backpack having a closeable flap in the front wall and a closeable flap in the top wall, and a closeable flap in the bottom wall;

i. the laundry backpack having a firm material in either the top wall or bottom wall to preserve the front to back dimensions of the backpack;

j. the backpack having carrying straps attached for carrying on the back of a person; and k. the backpack having at least one detachable hanging strap for attaching the backpack to an object for hanging the backpack.

2. The laundry backpack of claim 1 in which the detachable hanging strap has a U-shaped hanger attached to the end for hanging over an object, such as a door.

3. The laundry backpack of claim 1 in which there are two detachable hanging straps.

4. The laundry backpack of claim 1 in which there is a single stave in the closeable flap in the top wall and a plurality of staves in the closeable flap in the bottom wall.

5. The laundry backpack of claim 4 in which the plurality of staves in the closeable bottom flap have a length, which is perpendicular to the front wall.

6. The laundry backpack of claim 1 in which the closeable flap in the bottom wall is formed from a closed cell foam material.

7. The laundry backpack of claim 1 in which all of the closeable flaps are closed by double zippers.

8. The laundry backpack of claim 1 in which a substantial portion of each sidewall is constructed of mesh material.

9. The laundry backpack of claim 8 which has a plurality of adjustable straps on each sidewall running from the front wall to the back wall.

10. The laundry backpack of claim 9 in which the detachable hanging strap has a U-shaped hanger attached to the end for hanging over an object, such as a door.

11. The laundry backpack of claim 10 in which there are two detachable hanging straps.

12. The laundry backpack of claim 10 in which there is a single stave in the closeable flap of the top and a plurality of staves in the closeable flap in the bottom wall.

13. The laundry backpack of claim 12 in which all of the closeable flaps are closed by double zippers.

14. The laundry backpack of claim 13 in which the plurality of staves in the closeable bottom flap have a length, which is perpendicular to the front wall.

15. The laundry backpack of claim 1 in which the carrying strap is connected to the hanging strap by a female/male lock arrangement.

16. A laundry backpack bag for carrying and for hanging from an object, said backpack comprising:

a. a front wall with edges;

b. a back wall;

c. two intervening side walls with edges with one edge attached to the front wall and another edge attached to the back wall;

d. an intervening curved top wall with edges with one edge attached to the front wall and another edge attached to the back wall;

e. an intervening bottom wall with edges with one edge attached to the front wall and another edge attached to the back wall;

f. a wire-like D-shaped frame attached to the laundry backpack along the edges between the front wall, side wall, top wall and bottom wall;

g. a wire-like D-shaped frame attached to the laundry backpack bag along the edge between the back wall, side wall, top wall and bottom wall;

h. the laundry backpack having a closeable flap in the front wall and a closeable flap in the top wall having at least one stave, and a closeable flap in the bottom wall having at least one stave;

i. the backpack having carrying straps attached for carrying on the back of a person; and j. the backpack having at least one detachable hanging strap for attaching the backpack to an object for hanging the backpack.

* * * * *